US005848849A

United States Patent [19]

Kishi et al.

[11] Patent Number: 5,848,849

[45] Date of Patent: Dec. 15, 1998

[54] MANUAL PRINTER

[75] Inventors: Motoshi Kishi; Naohisa Kinoshita, both of Nagoya, Japan

[73] Assignee: Brother Kogyo Kabushiki Kaisha, Nagoya, Japan

[21] Appl. No.: 899,826

[22] Filed: Jul. 24, 1997

[30] Foreign Application Priority Data

Jul. 25, 1996 [JP] Japan ..... 8-215028
Dec. 28, 1996 [JP] Japan ..... 8-358506

[51] Int. Cl.[6] ..... B41J 3/36
[52] U.S. Cl. ..... 400/88; 347/109
[58] Field of Search ..... 400/88, 29; 347/109, 347/9, 57

[56] References Cited

U.S. PATENT DOCUMENTS 4,412,232 10/1983 Weber et al. ..... 400/88
4,901,164 2/1990 Kurosawa ..... 400/88

FOREIGN PATENT DOCUMENTS 1-190468 7/1989 Japan ..... 400/88
3-120064 5/1991 Japan ..... 400/88
3-297677 11/1991 Japan ..... 400/88

*Primary Examiner*—Christopher A. Bennett
*Attorney, Agent, or Firm*—Oliff & Berridge, PLC

[57] ABSTRACT

A manual printer includes a head unit. The head unit includes a recording head, a running roller and a projection coupled to a housing via a universal joint. The head unit can be tilted relative to the housing. The position of the head unit relative to a recording medium P is maintained even if the housing is tilted in any direction. A gap and an angle between the recording head and the recording medium P can be fixed which enables a stable printing operation.

24 Claims, 11 Drawing Sheets

MANUAL PRINTER

BACKGROUND OF THE INVENTION

1. Field of the Invention

The invention relates to a manual printer which is supported by a user's hand and executes a predetermined pattern of printing on a recording medium such as recording paper.

2. Description of Related Art

Conventional manual printers include an apparatus for printing in a desired position on various recording media. Printing by such a printer is executed by a user manually moving the printer on a recording medium at an arbitrary speed. A recording head prints on the recording medium according to the distance that the printer has moved. To print suitably, the position of the recording head relative to the recording medium must be fixed. In a conventional printer, the position of the recording head relative to the recording medium is fixed by holding the position of the printer by a contact part and a running roller provided at the lower end of the printer.

The above-described conventional printer must be moved manually, keeping the printer in a fixed position relative to the recording medium. However, it is difficult to move the printer as described above. Therefore, if the printer is tilted in one direction, the distance and angle between the recording head and the recording medium are not fixed and it is difficult to execute a stable printing operation.

SUMMARY OF THE INVENTION

The invention solves this problem and the object of the invention is to provide a printer in which the position of the recording head relative to the recording medium is maintained independent of the tilt of the printer to enable a stable printing operation.

A manual printer in accordance with the invention includes a housing that forms an exterior of the manual printer. A recording head prints on a recording medium. A head unit holds the recording head. A supporting member supports the head unit so that the head unit can be tilted relative to the housing.

The head unit holds the recording head so that it can be tilted relative to the housing and the position of the head unit relative to the recording medium is maintained without being tilted even if the housing is tilted a little. A gap and an angle between the recording head and the recording medium are fixed and stable printing operation is enabled.

In accordance with another aspect of the invention, a running roller and/or a guide member can also be provided. The manual printer is moved on a recording medium via the running roller and/or the guide member and a gap between the recording head and the recording medium is fixed. Two running rollers may also be provided and the manual printer may also be formed so that it contacts the recording medium at three points, such as at of the two running rollers and the one guide member.

The head unit is supported on the recording medium by the three points, i.e. at the two running rollers and the one guide member as described above, such that the position of the head unit is stable when printing. A gap and angle between the recording head and recording medium are fixed which enables a stable printing operation.

In accordance with another aspect of the invention, the supporting member of the manual printer can include a fixed member and a movable member. Preferably, the supporting member can also include a universal joint. The housing and the head unit are connected by a fixed member and a movable member and are preferably connected by a universal joint, such that the position of the head unit relative to the recording medium is fixed independent of the position of the housing even if the housing is tilted in any direction relative to the recording medium. A gap and angle between the recording head, which is held in the head unit, and a recording medium are fixed which enables stabler printing operation.

In accordance with another aspect of the invention, the manual printer can also include a printing timing generator for generating printing timing based upon the rotation of a running roller. The recording head can also be formed such that it prints according to a printing timing signal generated by the printing timing generator.

A printing timing signal is generated based upon the amount of rotation of a running roller. The recording head is driven according to the printing timing signal and stable printing operation is enabled independent of the travel speed of the printer.

In accordance with another aspect of the invention, a recording head according to an ink jet method may also be used as the recording head of the manual printer.

The structure of the recording head according to an ink jet method is simple, compared with that of wire dot matrix printing using a printing ribbon and others. The whole printer can be small-sized and clearer printing is enabled.

In accordance with another aspect of the invention, the recording head and a travel device for running the manual printer on a recording medium may also be provided integrally in the head unit. A supporting member may also be formed by a holder member for connecting the head unit to the housing, a first linkage for connecting the holder member and the housing and a second linkage for connecting the holder member and the head unit.

The travel device and the recording head are provided in the head unit integrally. The head unit is connected to the holder member by the second linkage and the holder member is connected to the housing by the first linkage such that the position of the recording head relative to the recording medium is fixed even if the body of the printer is tilted during printing and stable printing operation is enabled.

In accordance with another aspect of the invention, the second linkage may also be formed such that the head unit can be oscillated in the scanning direction of the manual printer. The first linkage may also be formed such that the head unit can be oscillated in a direction perpendicular to the scanning direction of the manual printer.

The body of the printer is formed so that it can be oscillated in the scanning direction and in the direction perpendicular to the scanning direction and the position of the recording head relative to the recording medium is fixed even if the body of the printer is tilted during printing and stable printing operation is enabled.

In accordance with another aspect of the invention, the first and second linkages may also include a crossed four-section linkage.

No force is applied to a part of the recording head in the direction in which the printer is tilted even if the body of the printer is tilted during printing if the linkage includes a crossed four-section linkage described above. The change in position of the recording head caused by a tilting of the body of the printer is improved and the position of the recording head relative to a recording medium can be more stably held.

In accordance with another aspect of the invention, the first and second linkages are provided at opposite sides and may also be formed so that the first linkage is parallel to the scanning direction and the second linkage is perpendicular to the scanning direction.

An opposing pair of first linkages are parallel to the scanning direction, and an opposing pair of second linkages are perpendicular to the scanning direction. Thus, the position of the head unit relative to a recording medium is fixed and can be held more stably even if the printer is tilted in either the scanning direction or the direction perpendicular to the scanning direction.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

Figure 1:
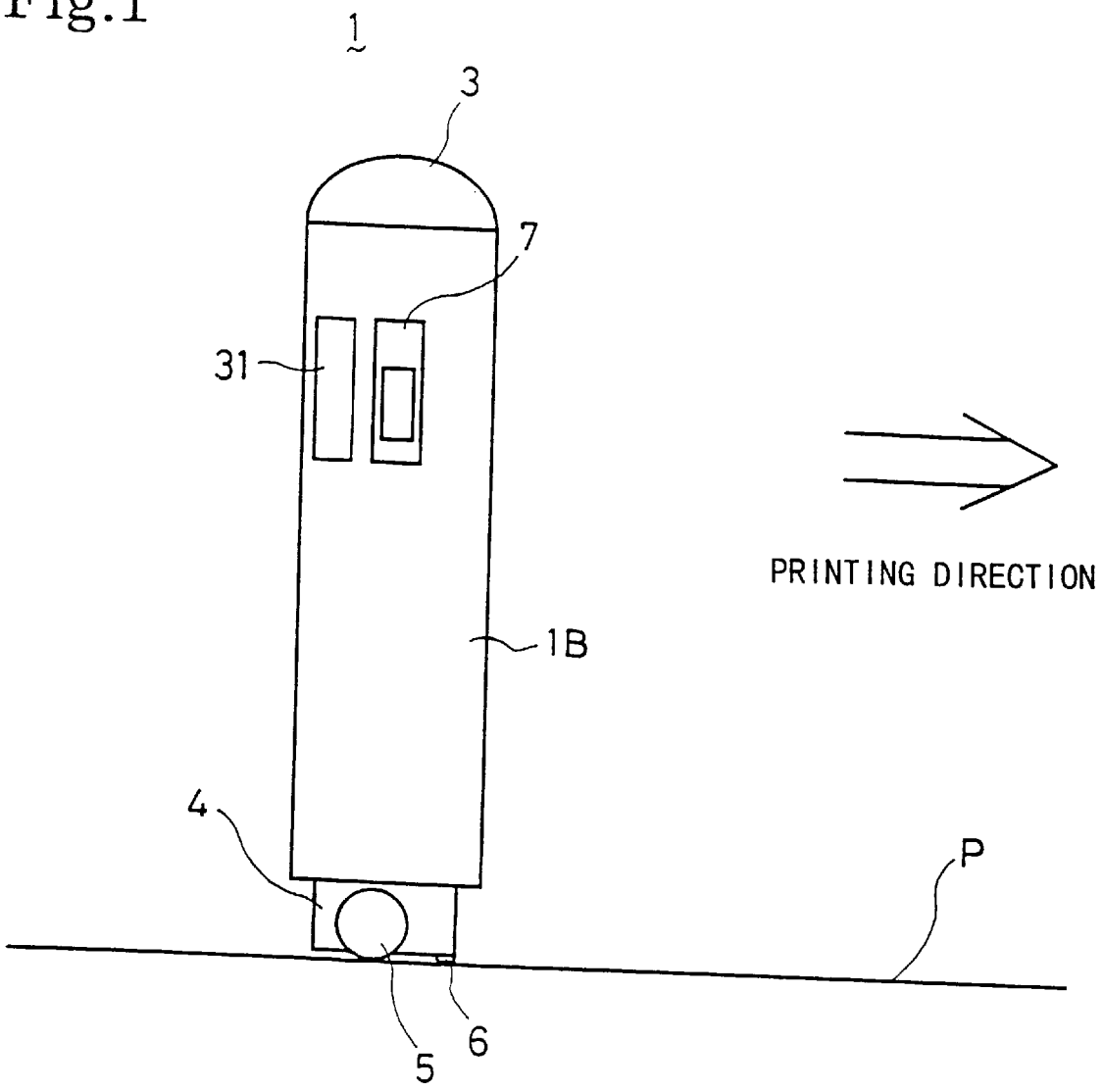
FIG. 1 is an elevational view showing a manual printer in accordance with the invention.

Referring to the drawings, the preferred embodiments of the invention will be described below.

First, referring to FIGS. 1–4, a first embodiment will be described. FIG. 1 is an elevational view of a manual printer in accordance with the invention. As shown in FIG. 1, the housing 1B of a manual printer 1 is rectangular and is formed so that a user can readily hold it in the user's hand. An infrared interface 3 for receiving or sending various data such as print data from/to an external device using infrared radiation is provided at the upper end of the housing 1B. A head unit 4 is provided at the lower end of the housing 1B. A recording head described below is built in the head unit 4. The head unit is provided with a running roller 5 which is formed so that it can be rotated and a projection (guide) 6 formed of a material such as slippery resin. A control panel 7 for turning a power source on or off and selecting the printing mode of the manual printer 1 is provided at the housing 1B.

When a user holds the housing 1B in the user's hand and scans on a recording medium P such as recording paper in the direction shown by an arrow in FIG. 1, contacting the running roller 5 and the projection 6 to the recording medium P, print data and other input from an external device are printed on the recording medium P. In printing, the running roller 5 and the projection 6 maintain the position of the head unit 4 and are formed so that a gap and angle between the recording head built in the head unit 4 and the recording medium P are fixed and when the running roller 5 is rotated during scanning, the relative position between the recording head and the recording medium P is detected and a predetermined printing operation is executed.

Figure 2:
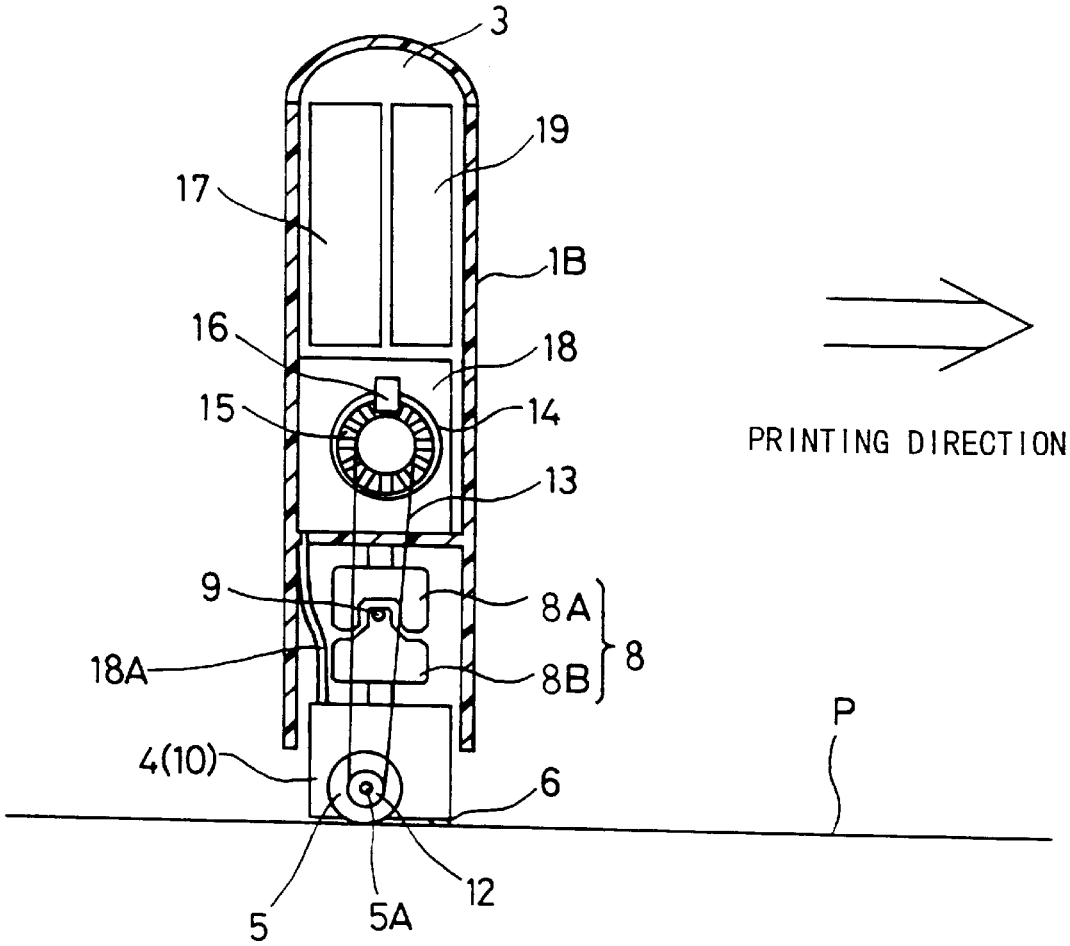
FIG. 2 is a sectional view showing the internal structure of the manual printer of FIG. 1.
Figure 3:
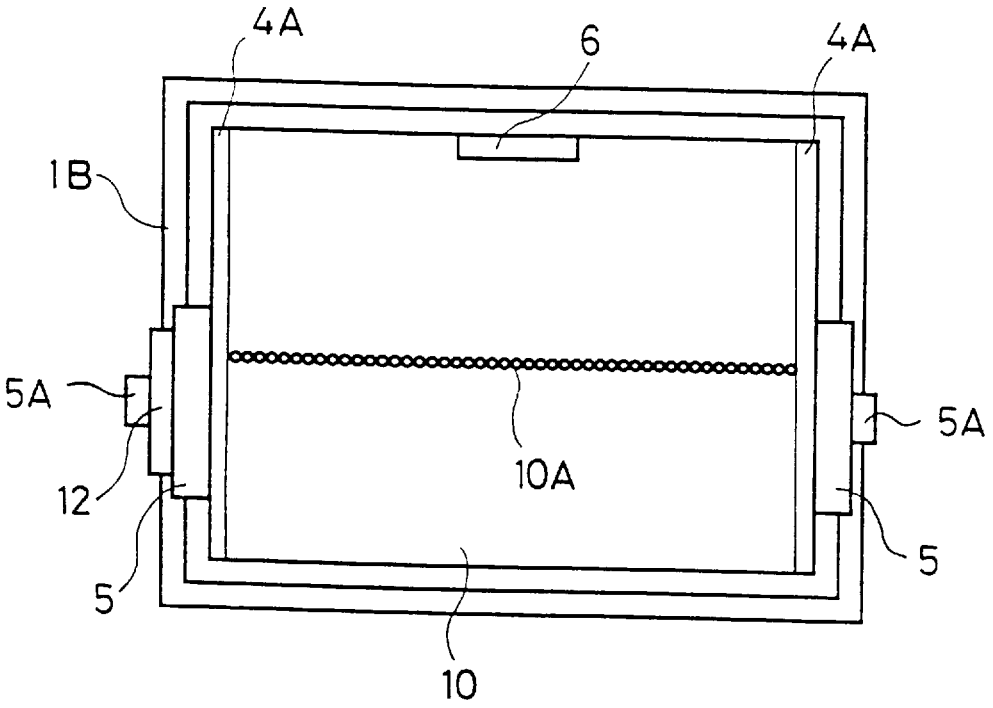
FIG. 3 is a bottom view showing the manual printer of FIG. 1.

FIG. 2 is a sectional view showing the internal structure of the manual printer 1. FIG. 3 is a bottom view showing the printer 1. The head unit 4 is supported by a universal joint 8 at the lower end of the housing 1B. The universal joint 8 includes a fixing member 8A and a movable member 8B, both of which can be rotated within a fixed range via a shaft 9 that is provided in the center. The head unit 4 can thereby be tilted relative to the housing 1B.

Multiple nozzles 10A are provided at the end of the recording head 10. The width of the recording head is formed so that it constitutes the maximum recording width in the direction perpendicular to a printing direction in a printing area. The projection 6 is integrated with the frame 4A of the head unit 4 ahead of the printing direction of the recording head 10. The running roller 5 is supported on the side of the frame 4A by a shaft 5A so that the running roller can be rotated. The part of the running roller 5 in which the running roller contacts the recording medium P is disposed outside a printing area by the recording head 10. As described above, as two running rollers 5 and the projection 6 contact the recording medium P at three points, the position of the head unit 4 can be held stable.

A pulley 12 is disposed on the shaft 5A of the running roller 5 so that the pulley is rotated in accordance with the rotation of the roller 5. A belt 13 is wound on the pulley 12 and is formed so that the torque of the pulley 12 rotated in accordance with the rotation of the roller 5 is transmitted to the rotary disc 15 of an encoder 14. A slit is provided at a predetermined interval on the circumference of the rotary disc 15. The rotating speed of the running roller 5, i.e., the relative position between the recording head 10 and the recording medium P, is converted to an interval between electric pulse signals by a photointerruptor 16 of the encoder 14 which is turned on or off by the rotation of the rotary disc 15. The signal is input to a control circuit 17 described below. The photointerruptor 16 is also formed so that it detects the rotational direction of the running roller 5. An ink reservoir 18 for supplying ink to the recording head 10 is provided on the side of the encoder 14. Ink in the ink reservoir 18 is sent to the recording head 10 through an ink supplying pipe 18A.

The control circuit 17 includes a CPU described below and other devices for controlling a recording operation of the recording head 10, a detecting operation of the photointerruptor 16 and further, the infrared interface 3 and others provided for receiving print data are arranged in the upper part of the housing 1B. A power source 19 for supplying electric power to each functional block described below is disposed on the side of the control circuit. The power source 19 may include a primary battery or a secondary battery, and for example, can include a small-sized power supplying section such as a manganic dry cell, an alkaline dry cell, an Ni-Cd battery, an NiMH battery and a lithium cell, a regulator for stabilizing such electric power and others.

Figure 4:
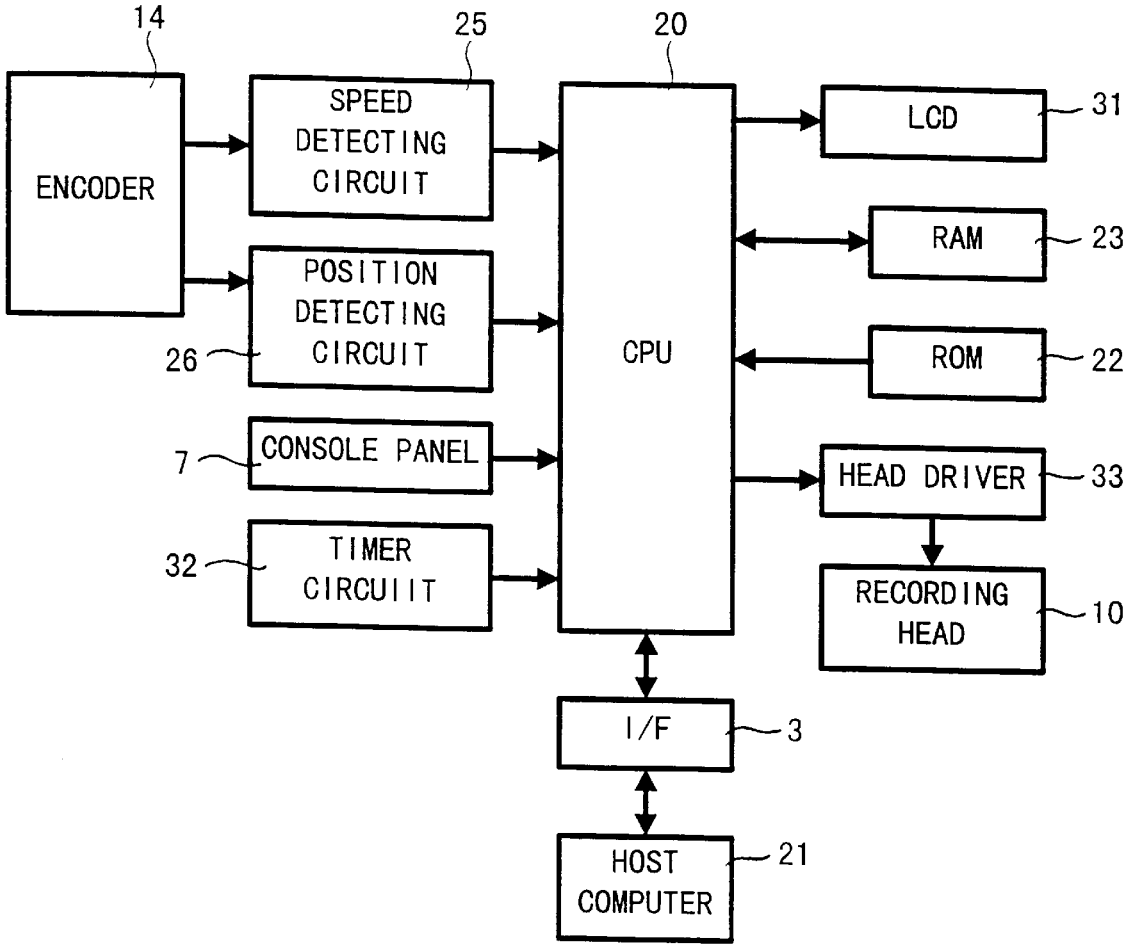
FIG. 4 is a block diagram showing the control system of the manual printer of FIG. 1.

FIG. 4 is a block diagram showing the control system of the manual printer 1. A host computer 21 is connected to CPU 20 for controlling the entire manual printer 1 via the infrared interface 3, and ROM 22 for storing a control program for controlling each functional block according to a determined program, RAM 23 for storing print data input from the host computer 21 via the infrared interface 3 and the console panel 7 are also connected to CPU 20. A pulse from the encoder 14 for measuring the amount of rotation, the rotating speed and the rotational direction of the running roller 5 is input to a speed detecting circuit 25 and a position detecting circuit 26. The speed of the manual printer 1 and the relative position between the manual printer and the recording medium P are detected by these circuits and the detection signal is input to CPU 20. The control circuit 17 includes CPU 20, ROM 22, RAM 23, the speed detecting circuit 25, the position detecting circuit 26, a timer circuit 32 and a head driver 33.

A display such as a liquid crystal display, i.e., LCD 31, for displaying various data such as the printing mode and the variation of the speed of the manual printer 1 and the timer circuit 32 for measuring printing time and others are also connected to CPU 20. Further, CPU 20 drives the recording head 10 via the head driver 33.

LCD 31 is fixed to the surface of the housing 1B so that the display can be seen by the user.

The operation of the above-described manual printer 1 will be described below. The manual printer 1 is operated accordingto a predetermined program stored in ROM 22. Print data is input by CPU 20 when a printing mode is selected on the console panel 7. Print data is input from the host computer 21 via the interface 3 in the form of an infrared signal and the input print data is stored in RAM 23. After CPU 20 verifies that print data is stored in RAM 23 when CPU 20 receives a printing start signal via an operation on the console panel 7, CPU changes the mode of the manual printer 1 into a printing standby mode.

Next, a user manually scans with the manual printer 1. If CPU 20 judges that the rotary disc 15 of the encoder 14 is rotated, the output of print data is controlled according to the amount of rotation of the roller 5, printing timing is generated and printing is executed on the recording medium P by driving the recording head 10 via the head driver 33 according to the printing timing. Therefore, even if the travel speed of the housing 1B on a recording medium P is not uniform, uniform printing can be always realized on the recording medium P.

The housing 1B and the recording head 4 are connected by the universal joint 8 in the manual printer 1 and the head unit 4 can be tilted relative to the housing 1B. The position of the head unit 4 relative to the recording medium P is maintained even if the position of the housing 1B is tilted in any direction. Thus, a gap and angle between the recording head 10 and the recording medium P are fixed to enable a more stable printing operation.

The invention is not limited to the above embodiment and various changes can be made. For example, in the above embodiment, the housing 1B and the head unit 4 are coupled by the universal joint 8 and are formed so that the head unit 4 can be tilted relative to the housing 1B. However, the housing 1B and the head unit 4 may also be connected by an elastic body such as rubber. The head unit 4 can be also tilted relative to the housing 1B with this structure, and a gap and angle between the recording head 10 held in the head unit 4 and the recording medium P can be fixed to enable a stable printing operation.

Next, referring to FIGS. 5–11, a manual printer 51 in accordance with a second embodiment of the invention will be described.

Figure 5:
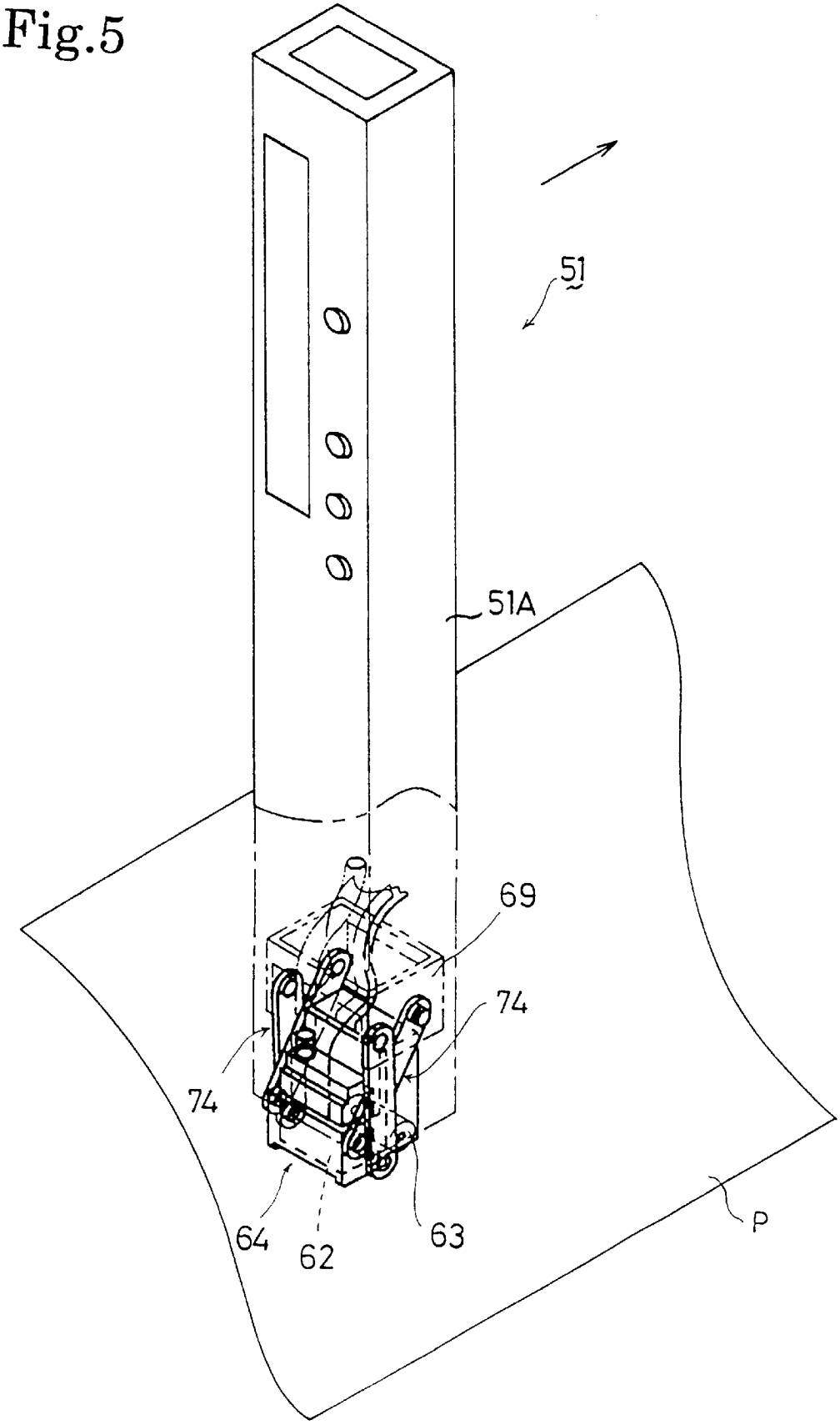
FIG. 5 is a perspective view showing a printing operation by the printer in accordance with the invention.
Figure 6:
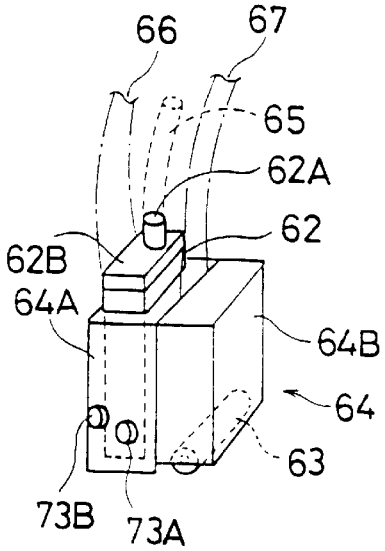
FIG. 6A is a perspective view showing the structure of a head unit.
FIG. 6B is a perspective view schematically showing the attachment of the housing of the body and the head unit and FIG. 6C is a side view of FIG. 6B.
Figure 6:
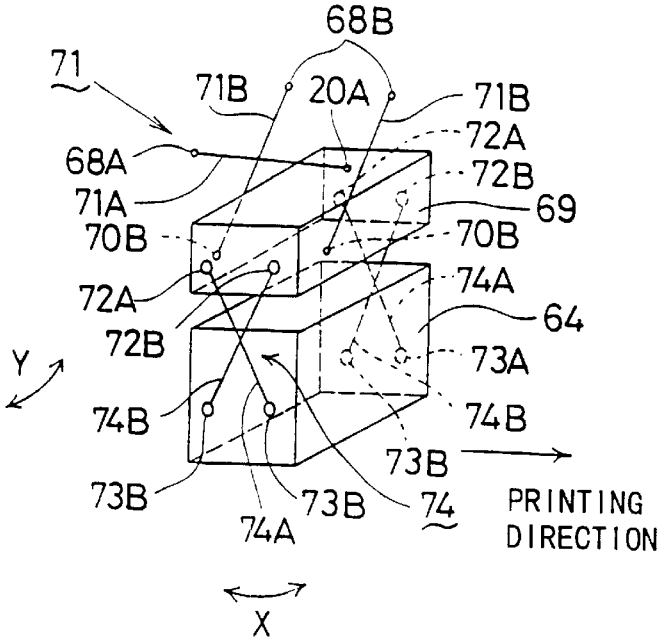
Figure 6:
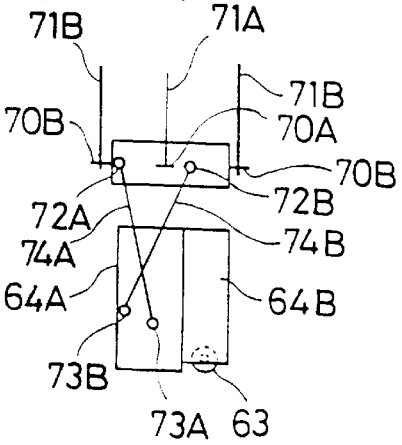

FIG. 5 is a perspective view showing a printing operation by the manual printer 51 of the second embodiment of the invention. The manual printer 51 is an ink jet manual printer for printing by scanning on the recording medium P such as paper, a head unit 64 in which a recording head 62 for printing by emitting ink and a roller 63 for running the manual printer 1 on the recording medium P are integrated and provided in the lower part of the housing 51A of the body. The housing 51A is connected to the head unit 64 by a first linkage 74 and a second linkage 71 described below so that the housing can be oscillated in the scanning direction and in the direction perpendicular to the scanning direction. The head unit 64 is formed so that the position head unit is fixed relative to the recording medium P even if the housing 51A is tilted which enables suitable printing. The details of this structure will be described below. If printing is executed by the manual printer 51, the manual printer 51 is mounted in a desired printing start position on a recording medium P as shown in FIG. 5 and is run in the direction shown by an arrow in FIG. 5. Ink is emitted from the recording head 62 according to the movement of the manual printer 5 and printing is executed on the recording medium P.

Referring to FIGS. 6A–6C, the structure of the connection between the housing 51A and the head unit 64 will be described below. FIG. 6A is a perspective view showing the structure of the head unit 64, FIG. 6B is a perspective view schematically showing an attachment between the housing 51A and the head unit 64 and FIG. 6C is a side elevational view of FIG. 6B. The head unit 64 includes a head holder 64A for supporting the recording head 62 and an encoder unit 64B for supporting the roller 63 and is provided with an encoder for detecting the amount of rotation of the roller 63. The recording head 62 is formed so that a fixed gap is maintained between the recording head and the recording medium P by the lower part of this head holder 64A and the roller 63.

An ink supply pipe 65 for leading ink from an ink cartridge, not shown, to the recording head 62 is connected to the connector 62A which is provided in the upper part of the recording head 62 and ink is supplied to the recording head 62 via a manifold 62B. Further, a flexible printing circuit, i.e., FPC 66 for inputting a control signal from a controller, not shown, and for controlling the operation of the whole manual printer 51 is connected to the recording head 62. The encoder in the encoder unit 64B is also connected to the controller via FPC 67. Shafts 73A and 73B for attaching a linkage which is described below are provided at the head holder 64A.

The head unit 64 is connected to the housing 51A via a holder 69 provided over the head unit 64. The housing 51A and the holder 69 are connected by the second linkage 71 that is formed by crossed members. The second linkage 71 includes three members, i.e., a pair of members 71B provided at shafts 68B and 70B between respective opposite sides of the housing 51A and the holder 69 so that the members can be rotated and an element 71A connecting the housing 51A and the center on the upper surface of the holder 69 via shafts 68A and 70A.

A four-section linkage includes crossed two-section arms, i.e., the first linkage 74 formed by crossing two elements is provided on shafts 72A, 72B, 73A and 73B between respective opposite sides so that the elements can be rotated with the respective elements as a pair between the holder 69 and the head unit 64. The elements 71B of the second linkage 71 connecting the housing 51A and the holder 69 are respectively arranged on the sides in the scanning direction and the elements 74A and 74B of the linkage 74 between the holder 69 and the head unit 64 are respectively arranged on the sides in the direction perpendicular to the scanning direction. Because of the above-described structure, the housing 51A can be oscillated in the direction shown by 'Y' in FIG. 6B relative to the recording medium P by the connection of the second linkage 71 and can be oscillated in the direction, i.e., the printing direction, shown by 'X' in FIG. 6B by the connection of the first linkage 74.

Figure 7:
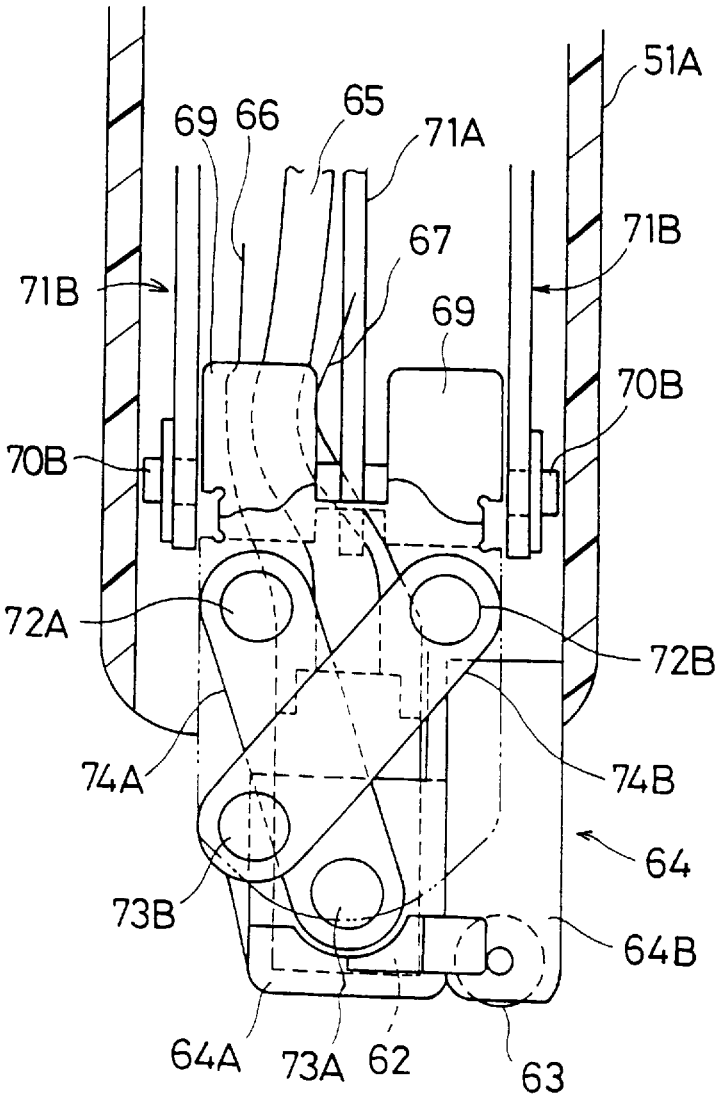
FIG. 7 is a sectional view showing an operation in which the head unit is not oscillated.
Figure 8:
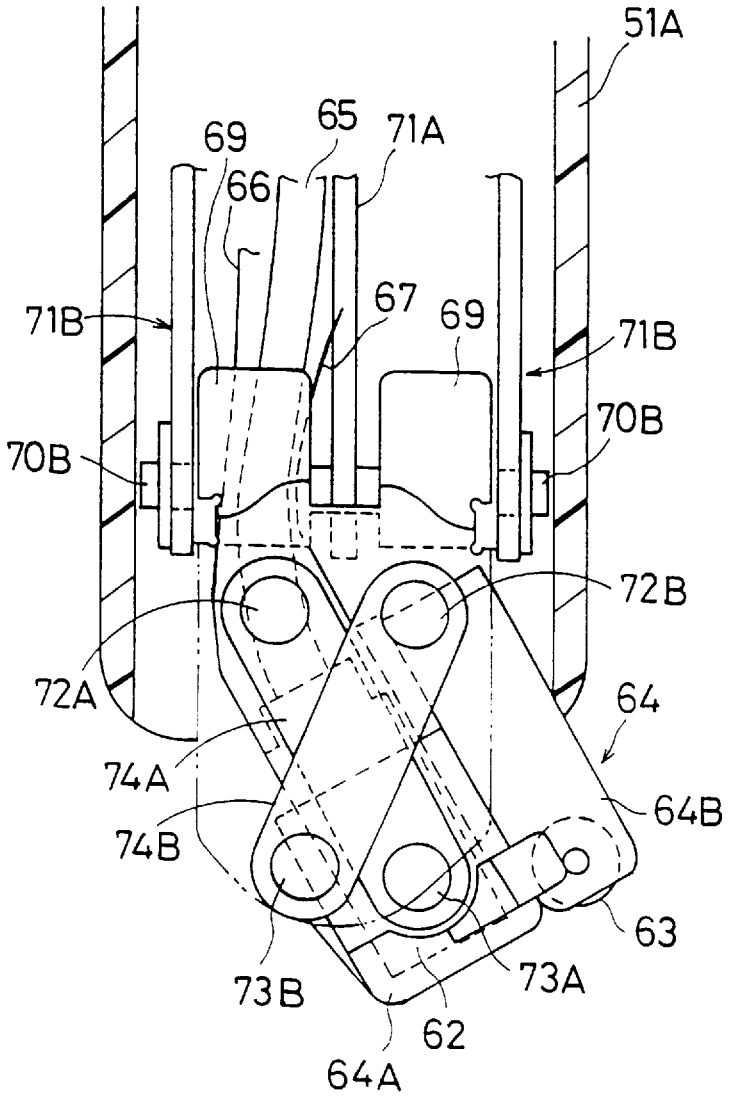
FIG. 8 is a sectional view showing an operation in which the head unit is oscillated in the printing direction.
Figure 9:
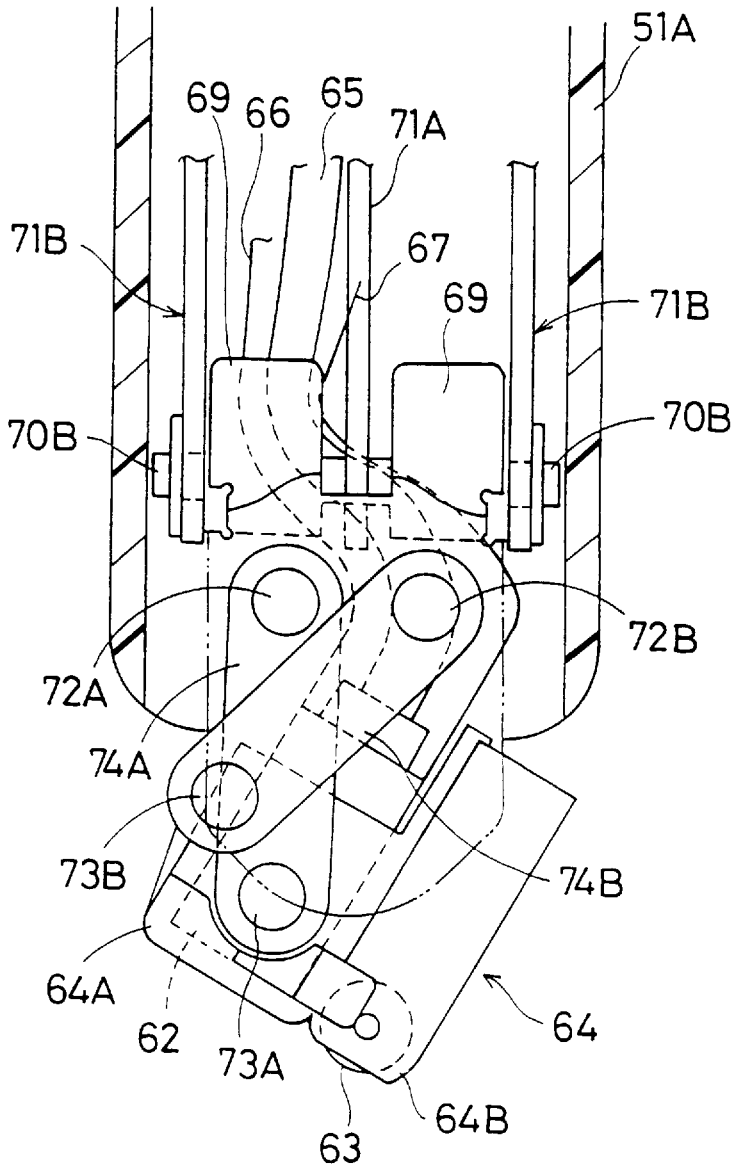
FIG. 9 is a sectional view showing an operation in which the head unit is oscillated in the direction opposite from the printing direction.

Next, referring to FIGS. 7–9, the oscillation of the head unit 64 relative to the holder 69 by the linkage 74 will be described. FIG. 7 is a sectional view showing an operation in which the head unit 64 is not oscillated, FIG. 8 is a sectional view showing an operation in which the head unit 64 is oscillated in the printing direction and FIG. 9 is a sectional view showing an operation in which the head unit 64 is oscillated in the direction opposite to the printing direction. As described above, the first linkage 74 is formed by crossing two members 74A and 74B. In a normal mode, i.e., in a mode in which no force is applied in the printing direction and the opposite direction to the housing 51A, the members 74A and 74B are set so that the head unit 64 is parallel to the housing 51A as shown in FIG. 7. When force is applied in the printing direction to the housing 51A from this mode, the member 74A is turned with the shaft 72A in the center and the member 74B is turned with the shaft 72B in the center respectively counterclockwise as shown in FIG. 8. As shown in FIG. 8, the head unit 64 is oscillated in the printing direction relative to the holder 69 and the housing 51A is tilted in the printing direction such that the position of the head unit 64 relative to the recording medium P is maintained.

When force is applied in the direction opposite to the printing direction to the housing 51A from a normal mode, the member 74A is turned with the shaft 72A in the center and the arm 74B is turned with the shaft 72B in the center respectively clockwise. As shown in FIG. 9, the head unit 64 is oscillated in the direction opposite to the printing direction to the holder 69 and the housing 51A is tilted in the direction opposite to the printing direction, such that the position of the head unit 64 relative to the recording medium P is maintained. At this time, as for the second linkage 71 connecting the holder 69 and the housing 51A, force is applied in the direction perpendicular to the sides on which the members 71A and 71B are turned, and the head unit 64 is not oscillated by the linkage 71.

Figure 10:
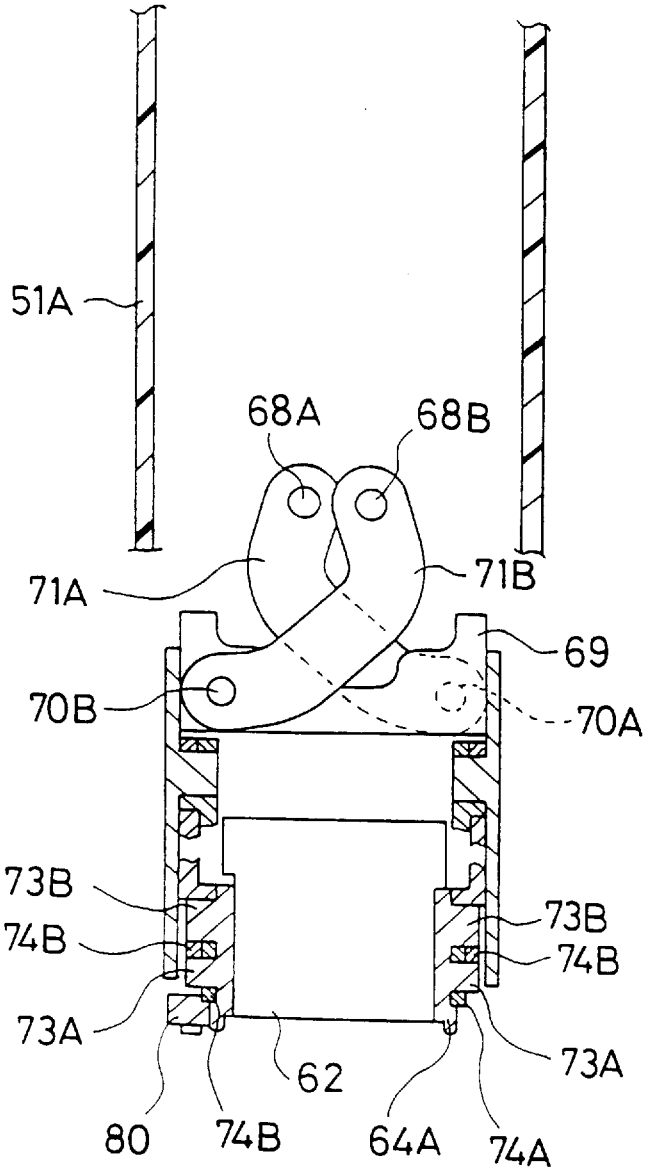
FIG. 10 is a sectional view showing an operation in which a holder and the head unit are not oscillated.
Figure 11:
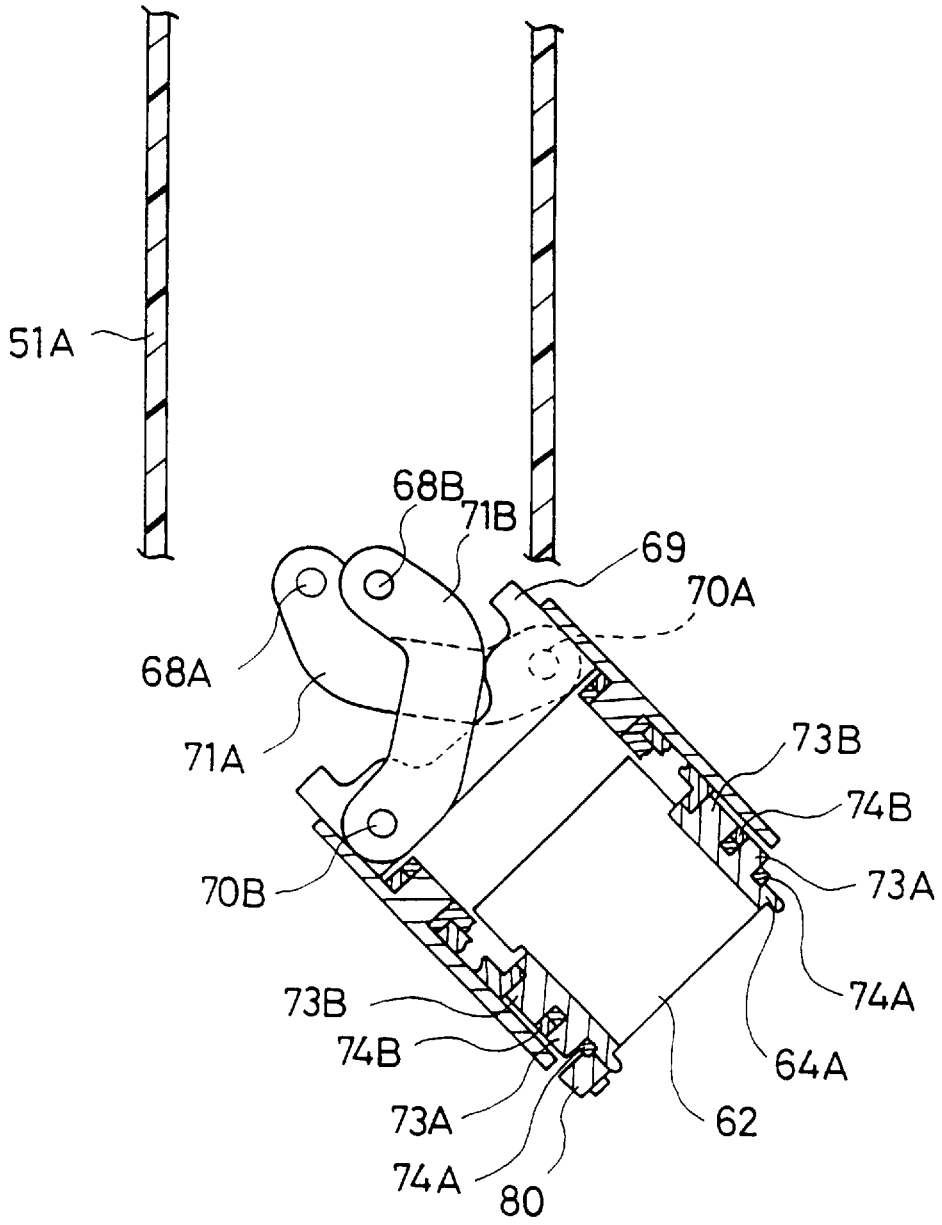
FIG. 11 is a sectional view showing an operation in which the holder and the head unit are oscillated on the side of a user.

Next, referring to FIGS. 10 and 11, the oscillation of the holder 69 and the head unit 64 relative to the housing 51A by the second linkage 71 will be described. FIG. 10 is a sectional view showing a mode in which the holder 69 and the head unit 64 are not oscillated and FIG. 11 is a sectional view showing a mode in which the holder 69 and the head unit 64 are oscillated on the side of a user. As described above, the second linkage 71 includes three crossed members, i.e., a pair of members 71B attached on the sides of the holder 69 and a member 71A attached on the upper surface of the holder 69. In a normal mode in which no force is applied at the side of a user and in the reverse direction to the housing 51A, the members 71A and 71B are set so that the holder 69 and the head unit 64 are parallel to the housing 51A as shown in FIG. 10. When force is applied at the side of a user to the housing 51A, to the right direction shown in FIG. 10 from this state, the member 71A is turned with the shaft 68A in the center and the member 71B is turned with the shaft 68B in the center respectively counterclockwise as shown in FIG. 10. As shown in FIG. 11, the holder 69 and the head unit 64 are oscillated in the right direction, i.e., at the side of a user, and the housing 51A is tilted at the side of a user such that the position of the head unit 64 relative to a recording medium P is maintained. At this time, as force is applied to the linkage 74 connecting the holder 69 and the head unit 64 in the direction perpendicular to sides on which the members 74A and 74B are turned, the head unit 64 is not oscillated by the linkage 74.

When force is applied in the direction opposite to the side of a user, i.e., to the left direction shown in FIG. 11 to the housing 51A from a normal mode though not shown as a figure, the member 71A is turned with the shaft 68A in the center and the member 71B is turned with the shaft 68B in the center respectively clockwise. The holder 69 and the head unit 64 are oscillated in the direction opposite to the side of a user to the housing 51A and the housing 51A is tilted on the side opposite to the side of a user such that the position of the head unit 64 relative to the recording medium P is maintained. At this time, the head unit 64 is also not oscillated by the linkage 74. A detecting switch 80 for detecting whether the recording medium P exists is provided on the left side of the head unit 64A as shown in FIG. 10.

As described above, the manual printer 1 of this embodiment is formed so that the head unit 64, in which the recording head 62 and the roller 63 are integrated, is connected to the housing 51A via the holder 69. The housing 51A can be oscillated in the scanning direction of the manual printer 1 and in the direction perpendicular to the above direction by virtue of the four-section linkage 71, in which two members are crossed, connects the holder 69 and the housing 51A. The four-section linkage 74 in which two members are crossed connects the head unit 64 and the holder 69. The members 71B of the linkage 71 between the housing 51A and the holder 69 are arranged in the scanning direction in parallel and the linkages 74 between the holder 69 and the head unit 64 are arranged in the direction perpendicular to the scanning direction. The position of the head unit 64 relative to the recording medium P is fixed even if the housing 51A is tilted in either the scanning direction or the direction perpendicular to the scanning direction during printing which enables stable printing operation when the housing 51A is tilted. The oscillation of the head unit 64 relative to the positional variation of the housing 51A is improved because the linkages 71 and 74 are adopted for the connection of each member, and the position of the head unit 64 can be held more stably.

The invention is not limited to the structure of the above embodiments and various changes can be made. For example, in the above embodiments, the members 71B of the second linkage 71 between the housing 51A and the holder 69 are arranged in the scanning direction in parallel and the first linkages 74 between the holder 69 and the head unit 64 are arranged in the direction perpendicular to the scanning direction. However, the invention is not necessarily limited to this structure. The members 71B of the second linkage 71 between housing 51A and the holder 69 may also be arranged in the direction perpendicular to the scanning direction, and the first linkages 74 between the holder 69 and the head unit 64 may also be arranged in the scanning direction in parallel. The recording head 62 is consistent with an ink jet method. However, it may be used with another method, for example wire dot matrix printing.

What is claimed is:

1. A manual printer for printing on a recording medium via a user manually moving the manual printer on the recording medium, comprising:

a housing defining an exterior of the manual printer;

a recording head that prints on the recording medium;

a head unit holding said recording head; and a supporting member that supports the head unit, the supporting member including a holder member for connecting the head unit to the housing, a connecting unit that connects the holder member to the housing such that the head unit can oscillate in a direction perpendicular to a scanning direction of the manual printer, and a connecting unit that connects the holder member and the head unit so that the head unit can oscillate in the scanning direction of the manual printer.

2. The manual printer according to claim 1, further including:

a running roller that is rotated by moving the manual printer while contacting the recording medium.

3. The manual printer according to claim 2, further including:

a guide that holds said head unit in contact with the recording medium.

4. The manual printer according to claim 1, wherein:

said supporting member includes a fixed member and a movable member.

5. The manual printer according to claim 3, further including another running roller, wherein said head unit contacts the recording medium at three points via the running roller, the another running roller, and the guide.

6. The manual printer according to claim 2, further including:

a printing timing generator that generates printing timing based upon the amount of rotation of the running roller, wherein:

said recording head prints according to a printing timing signal generated by said printing timing generator.

7. The manual printer according to claim 6, wherein:

said recording head includes an ink jet recording head.

8. The manual printer according to claim 1, further including:

a travel device that enables the manual printer to travel on the recording medium, the travel device being integrated with the recording head in said head unit; and wherein the connecting unit that connects the holder member to the housing includes a first linkage, and the connecting unit that connects the holder member and the head unit includes a second linkage.

9. The manual printer according to claim 8, wherein:

said first and second linkages each include a crossed linkage.

10. The manual printer according to claim 8, wherein:

the first and second linkages each include opposing linkages;

said first linkage is parallel to a scanning direction; and said second linkage is perpendicular to the scanning direction.

11. The manual printer according to claim 10, wherein:

said recording head includes an ink jet recording head.

12. A manual printer for printing on a recording medium via a user manually moving the manual printer on the recording medium, comprising:

a housing defining an exterior of the manual printer;

means for printing on the recording medium;

means for holding said means for printing; and means for supporting the means for holding, the means for supporting including means for connecting the means for holding to the housing, first linkage means for connecting the means for connecting and the housing such that the means for holding can oscillate in a direction perpendicular to a scanning direction, and second linkage means for connecting the means for connecting and the means for holding such that the means for holding can oscillate in the scanning direction.

13. The manual printer according to claim 12, further including:

means for facilitating the movement of the manual printer along the recording medium while contacting the recording medium.

14. The manual printer according to claim 13, further including:

means for maintaining said means for holding in contact with the recording medium.

15. The manual printer according to claim 12, wherein:

said means for supporting includes a fixed member and a movable member.

16. The manual printer according to claim 14, wherein the means for facilitating the movement of the manual printer includes two running rollers, the means for maintaining includes a guide, and said means for holding contacts the recording medium at three points via the two running rollers and the guide.

17. The manual printer according to claim 13, further including:

means for generating printing timing based upon the amount of rotation of said means for moving, wherein:

said means for printing prints according to a printing timing signal generated by said means for generating.

18. The manual printer according to claim 17, wherein:

said means for printing includes an ink jet recording head.

19. The manual printer according to claim 12, further including:

means for running the manual printer on the recording medium which is integrated with the means for printing in said means for holding; and wherein said means for supporting includes means for connecting said means for holding to said housing, first linkage means for connecting said means for connecting and said housing and second linkage means for connecting said means for connecting and said means for holding.

20. The manual printer according to claim 19, wherein:

said first linkage means and second linkage means each include a crossed four-section linkage.

21. The manual printer according to claim 19, wherein:

the first and second linkages each include opposing linkages;

said first linkage means is parallel to a scanning direction; and said second linkage means is perpendicular to the scanning direction.

22. The manual printer according to claim 21, wherein:

said means for printing is an ink jet recording head.

23. A method of printing on a recording medium by manually moving a manual printer on the recording medium, the manual printer including a housing defining an exterior of the manual printer, comprising the steps of:

inputing print data from an external device;

moving the manual printer with a running roller in contact with the recording medium;

holding the head unit in contact with the recording medium with a guide;

generating printing timing based upon the amount of rotation of said running roller with a printing timing generator;

oscillating a head unit in a scanning direction with a second linkage;

oscillating the head unit in a direction perpendicular to the scanning direction with a first linkage; and printing on a recording medium with a recording head, such that the recording head is held with the head unit, the head unit is supported with a supporting member and the recording head prints according to a printing timing signal generated by the printing timing generator.

24. A manual printer for printing on a recording medium via a user manually moving the manual printer on the recording medium, comprising:

a housing defining an exterior of the manual printer;

a recording head that prints on the recording medium;

a head unit holding said recording head; and a supporting member including a universal joint that supports the head unit so that said head unit can be tilted relative to said housing in a scanning direction and a direction perpendicular to the scanning direction.

* * * * *